US006588019B1

(12) United States Patent
Whittle, Jr.

(10) Patent No.: US 6,588,019 B1
(45) Date of Patent: Jul. 8, 2003

(54) IMPACT STRUCTURE FOR THE ABSORPTION OF IMPACT FORCES TO THE BODY

(76) Inventor: Keith F. Whittle, Jr., 1030 Towanda Ter., Cincinnati, OH (US) 45216

( * ) Notice: Subject to any disclaimer, the term of this patent is extended or adjusted under 35 U.S.C. 154(b) by 0 days.

(21) Appl. No.: 09/146,183

(22) Filed: Sep. 3, 1998

Related U.S. Application Data

(60) Provisional application No. 60/073,502, filed on Feb. 3, 1998.

(51) Int. Cl.[7] ..... A41D 20/00
(52) U.S. Cl. ..... 2/16; 2/170
(58) Field of Search ..... 2/455, 16, 20, 2/22, 24, 161.1, 170, 456, DIG. 3, 267; 602/19–27, 61–65

(56) References Cited

U.S. PATENT DOCUMENTS 3,786,804 A * 1/1974 Lewis ..... 128/80 C
3,924,272 A * 12/1975 Allen et al. ..... 2/16
4,198,708 A * 4/1980 Fugere et al. ..... 2/16
4,453,271 A * 6/1984 Donzis ..... 2/456
4,599,747 A * 7/1986 Robinson ..... 2/461
4,707,861 A * 11/1987 Lavoie et al. ..... 2/16
4,896,378 A * 1/1990 Campana ..... 2/170
5,168,576 A * 12/1992 Krent et al. ..... 2/267
5,334,135 A * 8/1994 Grim et al. ..... 602/26
5,418,980 A * 5/1995 Kelly ..... 2/170
5,500,956 A * 3/1996 Schulkin et al. ..... 2/161.1
5,524,292 A * 6/1996 Hargens ..... 2/24
5,581,805 A * 12/1996 Rennick ..... 2/455

* cited by examiner

*Primary Examiner*—John J. Calvert
*Assistant Examiner*—Tejash Patel
(74) *Attorney, Agent, or Firm*—Theodore P. Cummings

(57) ABSTRACT

The present invention provides an impact structure for the absorption of impact forces to the body. The impact structure is worn about a joint and/or muscle group of the body to protect that particular area from forceful blows in such common activities as football, basketball, construction work, etc. The impact structure generally comprises a sheath that fits snugly about the body part of a wearer, one or more impact zones which absorb the impact of a blow, and/or a protective cover which positions the impact zones to be in their correct-anatomical position on a wearer's body member. The protective cover is also used to provide a further defense about the a wearer's body member.

13 Claims, 5 Drawing Sheets

IMPACT STRUCTURE FOR THE ABSORPTION OF IMPACT FORCES TO THE BODY

The above-named patent application in the name of Keith F. Whittle, Jr. hereby claims priority to Provisional Application No. 60-073502 entitled "AN IMPACT STRUCTURE FOR THE ABSORPTION OF IMPACT FORCES TO THE BODY" and filed on Feb. 3, 1998 according to 35 U.S.C. § 119(e).

FIELD OF THE INVENTION

The present invention provides an impact structure for the absorption of impact forces to the body. The impact structure is worn about a joint and/or muscle group of the body to protect that particular area from forceful blows in such common activities as football, basketball, construction work, etc.

BACKGROUND

Since man's earliest emergence on the earth, he has searched for protective covering. As man sought to survive in harsh climates and conditions, he made thick skins for himself to brave the elements. When man became more sophisticated and sought to war against his fellow man, he took to battle with him spear and shield, sword and armor. From his beginning, man has known that his skin is not filly impermeable and must be protected.

When man developed games which simulated war and battle, he likewise saw a need to defend his body against puncture and breaking. Also, as man, though injured, has continued to participate in physically challenging activities, a need to protect an injured body part has arisen as man continued in his activity.

One example of such a protective device is the Forearm Shield Pad disclosed in U.S. Pat. No. 4,707,861, issued on Nov. 24, 1987. The device comprises a rigid, elongated plate surrounded by a sheath having shock-dampening material. Straps extend about the device to secure it to a wearer.

U.S. Pat. No. 5,445,858 entitled Attenuating Pad issued on Aug. 29, 1995 discloses a gel-encapsulated, load-supporting pad with an outer sheath provided with extended flanges for attachment to a wearer. The attenuating device further discloses an elastomeric foam casing positioned between the outer sheath and the encapsulated shock-absorbing member.

Lastly, U.S. Pat. No. 3,924,272 entitled Protective Device For Use By Football Athletes issued on Dec. 9, 1975 describes a device for protecting against injuries to the hand, wrist, and arm of an athlete during athletic contests. The device comprises a resilient material having a tough outer coating generally shaped to cover and protect parts of the hand, wrist, arm and elbow.

Although these embodiments have worked adequately for their uses, they have been limited in their scope and application.

Therefore, it is an object of the invention herein to provide an embodiment that is flexible and resilient.

It is a further object herein to provide an embodiment that anatomically fits about the joint and/or muscle group of a wearer.

It is a further object herein to provide protection to an injured part of the body.

It is another object herein to provide an embodiment that will receive and absorb a substantial amount of impact forces striking the embodiment.

These and other objectives will be shown more fully in the specification.

SUMMARY

Accordingly, the invention provides a flexible and resilient impact structure for the absorption of impact forces directed toward a wearer and positioned onto a wearer's body. The impact structure generally comprises a sheath having two ends, an opening positioned at each end, a perimeter positioned about each end and at least one impact zone positioned on the impact structure. Preferably, there is a plurality, i.e., more than one, impact structure positioned to face outwardly from the surface of the sheath. The impact structure is flexible and resilient because it fits anatomically to a wearer's joint and/or muscle group with little or substantially no gapping. Further, such resilience means that the impact structure will bend and stretch within the range of motion and according to the movement of a joint and/or muscle group.

The impact zones may be positioned externally onto the sheath. But also, they may be positioned either beneath or within the sheath itself so as not to be readily discernible. In one embodiment herein, the plurality of impact zones comprise separate, unattached elements from one-another. More specifically, the impact zones are not attached or joined to each other in a network. However, in another embodiment, the plurality of impact zones may be at least partially interconnected. And further still, the impact zones may form an interconnected network.

In one embodiment herein, the impact zones, as wholly separate elements, may be attached to the sheath. In another embodiment, the impact zones are integrated into the sheath of the impact structure, i.e., made part and parcel of the sheath. Where the impact zones and the sheath form two separate types of elements, they may be attached, in one embodiment, the impact zone and the sheath are attached to one-another about lines of joinder, generally, but not always, being about their mutual perimeters.

A protective cover may be positioned about the sheath of the impact structure or the sheath may serve as the protective cover of the entire impact structure. Where the protective cover is a separate element, it will be formed to the geometry of the impact structure. More specifically, the protective cover will have two ends, an opening positioned about each end, and a perimeter positioned about each end. The protective cover will serve as the top or upper layer of the impact structure or that layer that faces most outwardly away from the skin of a wearer.

Where the protective cover is at least partially a separate element from the rest of the impact structure, it may be at least partially attached to the sheath. Preferably, the protective cover comprises at least one opening on the surface thereof to allow the impact zone to protrude therethrough from the surface of the sheath. The protective sheath is made from one or more of the materials from the group consisting of leather, nonwovens, cotton, polyester, polyethylene, polypropylene, foam, sponges, rayon, or any combination of the foregoing.

The impact zones preferably comprise at least one material from the group consisting of inert gases, air, water, sand, foam, sponges, liquids, semi-solids, solids or combinations of the foregoing.

Alternatively, the impact structure may deliver heat to a wearer. This impact structure preferably comprises activatable heating zones. In one embodiment of the foregoing, the activatable heating zones face inwardly toward the skin of a wearer. The activatable heating zones are preferably activated upon impact to one or more of the impact zones. The activatable heating zones may be separate from the impact zones. Alternatively, the activatable heating zones may be integrated elements with the impact zones, i.e., the impact zones and the activatable heating zones may be one and the same serving at least one function.

DESCRIPTION OF THE FIGURES

While the specification concludes with claims particularly pointing out and distinctly claiming the subject matter which is regarded as forming the present invention, it is believed that the invention will be better understood from the following description taken in conjunction with the accompanying drawings, in which:

FIG. 12A is a side view of the impact structure being worn about an arm showing the prominent, underlying muscle tissue;

FIG. 12B is a side view of the impact structure being worn about an arm showing the prominent, underlying bone structure; and FIG. 13 is a top view of a portion of the impact zone network.

DETAILED DESCRIPTION OF THE INVENTION

The invention herein comprises an impact structure that is fitted about a body part of a wearer. By the term"fitted" it is meant herein that the impact structure may provide a snug fit by the use of inherent tensile and compressive forces exerted by the structure onto the body of a wearer. Typical body parts which may have the impact structure positioned thereon include joints (e.g., the elbow, ankle, knee, wrist, etc.) or other flesh and bone areas which a wearer desires to protect (e.g., thigh, forearm, bicep, shoulder, calf, etc.). The sports impact structure is designed to receive and absorb blows to particular parts of the body wearing the impact structure to substantially prevent or lessen possible injury. Also, the impact structure can be so adorned as to provide an aesthetic appeal to wearers. Typically the impact structure has a length of between about 0.1 to about 40 inches. The circumference is not set but may be customized to fit the an area of the body meant to be worn by the impacted structure.

As is shown in FIGS. 6–12, the invention herein comprises an impact structure 10, preferably being fitted, that is positioned about a body part of a wearer. Suitable body parts may include joints such as those at the elbow, ankle, knee, wrist, etc. or other flesh and bone areas which a wearer desires to protect, for example, the thigh, fdrearm, bicep, shoulder, calf, etc. The fitted impact structure 10 is designed to receive and absorb blows to particular parts of the body wearing the impact structure 10 to substantially prevent or lessen possible injury. Also, the impact structure 10 can be so adorned as to provide an aesthetic appeal to wearers. Typically, the impact structure 10 h as a length of between about 0.1 to about 40 inches. The circumference may be set to fit an area of the body meant to be worn by the fitted pad.

Figure 6:
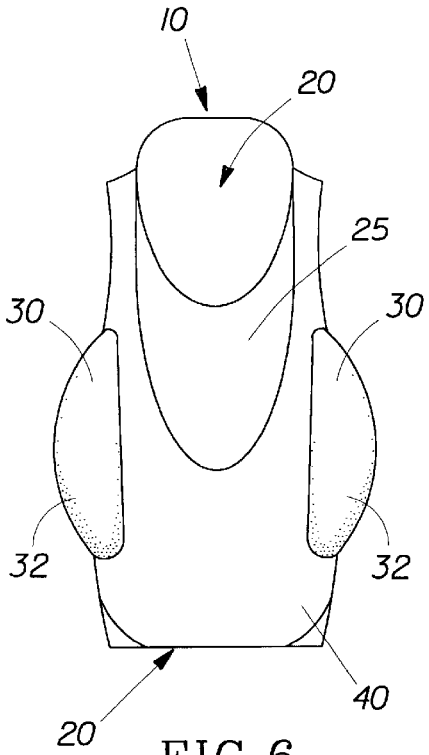
FIG. 6 is a plan view of the front of the impact structure.

FIG. 6 shows a front view the impact structure 10. Also, two impact zones 30 are shown protruding outwardly from the sheath 25 of the structure 10. Preferably, the sheath 25 would be permeable to air, absorbent to liquid (like sweat) and move and bend easily with the movements of a wearer without losing its form, shape or comfort. The structure 10 comprises two openings 20, each opening 20 being positioned at either end of the structure 10. In practice, a wearer will slip a body part, e.g., an arm, through the openings 20 and then position the impact structure 10 into position about a joint and/or muscle group to protect a wearer's covered body area from impact.

The impact structures described herein are preferably fitted to a part of a wearer's body such that when the impact structure 10 is applied to a body part; e.g., a joint of a wearer, the undersurface 28 (not shown) of the sheath 25 and thus the impact structure 10 conforms to that body part. Such impact structure conformation occurs due to the fitted characteristics of the sheath 25. Preferably the undersurface 28 comprises elastic material that enables the undersurface 28 to conform to a part of a wearer's body.

Figure 7:
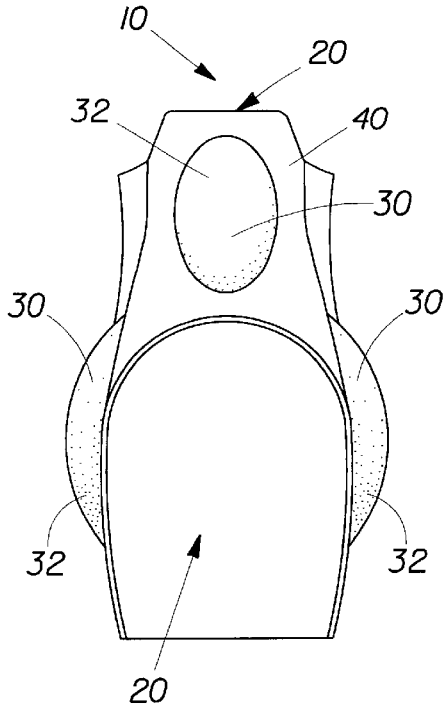
FIG. 7 is a plan view of the back of the impact structure.

FIG. 7 shows the back of the impact structure 10. In addition to the impact zones 30 shown protruding from the sides of the structure 10, another impact zone 30 is shown positioned on the back of the structure specifically intended to absorb impacts arriving from the back of a wearer.

The impact zones 30 may be separate structures attached to the sheath 25 or integrated with the sheath 25. By the term "integrated" it is meant herein that one element may be at least part of the structure of another element. In another embodiment herein, at least two impact zones 30 may be connected to form a network 50 (FIG. 13) of impact absorption. This network 50 operates such that when one or more impact zones 30 compressed, pressure from that compressed zone 30 is moved through the network arms 33 to other non-compressed zones 30 such that impact forces are equally or nearly equally distributed throughout the network 50. This is a great benefit because it results in more than one impact zone receiving the brunt of, for example, an un-tempered force by a falling object or rushing linebacker.

FIG. 13 provides an upper image of an interconnected network of impact zones 30. The zones 30 are shown to be connected through network arms 33 that extend between the impact zones 30. The network arms 33 serve as conduits through which the inner substance 34 flows when one or more of the impact zones 30 is forcefully impacted. FIG. 13 shows one particular type of configuration of the network 50 and network arms 33, however, it will be readily apparent to one skilled in the art that the network 50 may be so constructed as to maximize or minimize the amount of transferred force from an impact as is desired. Thus, the network 50 represents just one type of many possible configurations herein.

The impact zones 30 generally comprise an outer cover 32 and an inner substance 34 (not shown). The outer cover 32 may be formed from polyethylene, polypropylene, leather, nonwovens, polyester, cotton fabric, vinyl, any type of wearable material, and any combination of the foregoing. The inner substance 34 may comprise inert gases, air, water, sand, foam, sponges, liquids, semi-solids, solids and any combination of the foregoing. In fact, any substance suitable for the absorption of impact forces common to the use of the impact structure 10 and is correspondingly non-toxic to the skin of a wearer is acceptable and within the purview of this disclosure.

Figure 8:
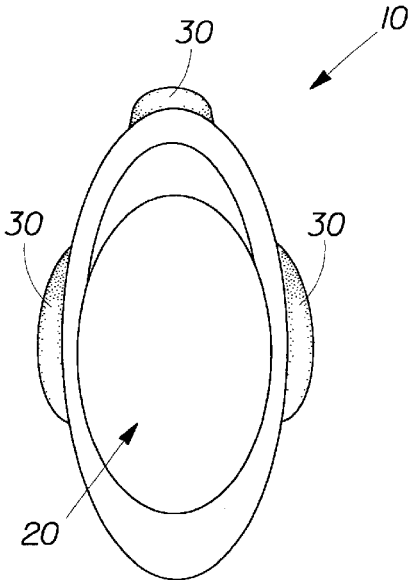
FIG. 8 is a plan view of the top of the impact structure.
Figure 9:
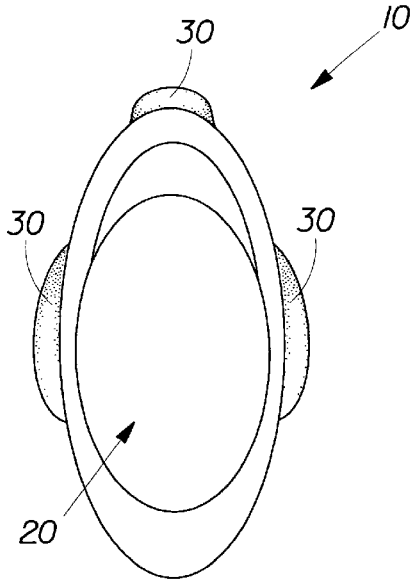
FIG. 9 is a plan view of bottom of the impact structure.
Figure 10:
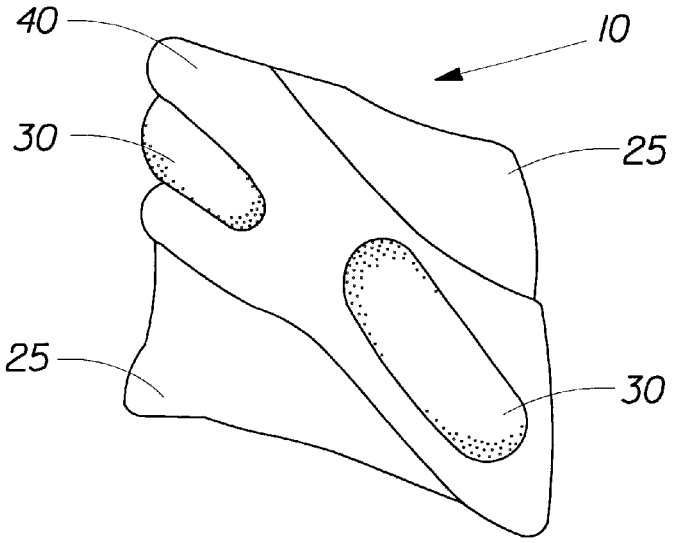
FIG. 10 is a side view of the impact structure in its orientation of wear.

FIGS. 8 and 9 show the top and bottom of the impact structure 10, respectively. Referring again to FIGS. 6 and 7, the sheath 25 may have a protective cover 40 positioned thereon. Alternatively, the sheath 25 may serve as its own protective cover 40. Where the sheath 25 and the protective cover 40 are distinct and separate elements, they will preferably be at least partially attached to one-another. Also, the protective cover 40 may be attached to one or more of any present impact zones 30 which could be attached to the sheath.

In an alternative embodiment herein, neither the protective cover 40, or the impact zones 30 or the sheath 25 are attached to one-another. Instead, the impact zones 30 and the sheath 25 may be so positioned as to provide a taut or fitted grip to the sheath 25 such that no adhesive, stitching or attachment means are necessary to fit the sheath 25, impact zones 30 and protective cover 40 together.

The impact zones 30 may be attached to the sheath 30 by hooks and loops. That is, the outer surface of the sheath 25 may comprise hooks or loops and the inner or attachment surface of a impact zone 30 may correspondingly comprise loops or hooks for attachment to the sheath 25. This is an advantageous embodiment because impact zones 30 of varying length, width and protuberance from the outer surface of a sheath 25 could be applied and repositioned on the sheath 25 as is fitting a wearer's needs.

Figure 1:
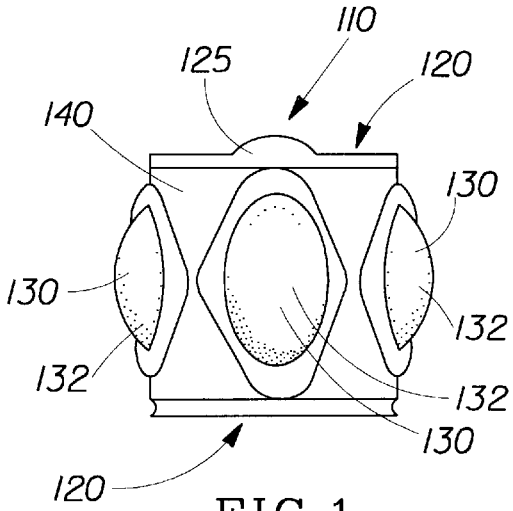
FIG. 1 is a plan view of the side of an alternative embodiment of the impact structure.
Figure 2:
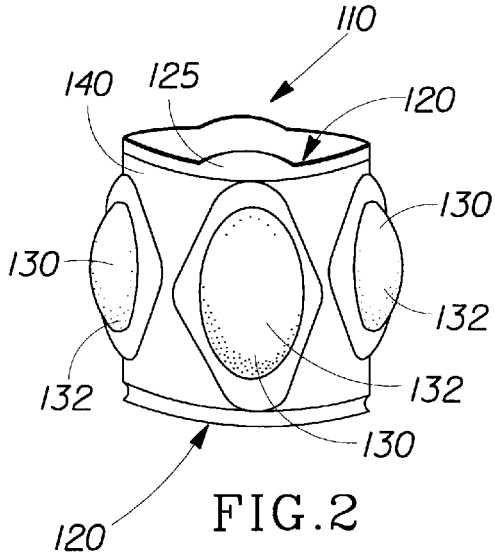
FIG. 2 is a side-perspective view of an alternative embodiment of the impact structure.
Figure 3:
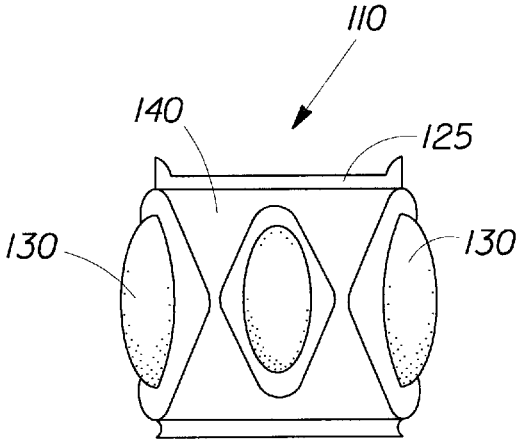
FIG. 3 is a plan view of the front of an alternative embodiment of the impact structure.
Figure 4:
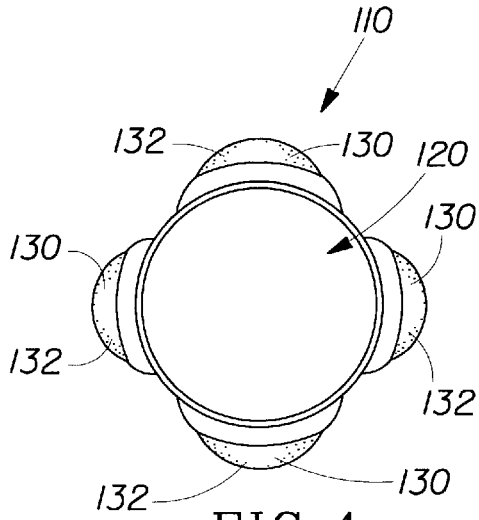
FIG. 4 is a top view of an alternative embodiment of the impact structure.
Figure 5:
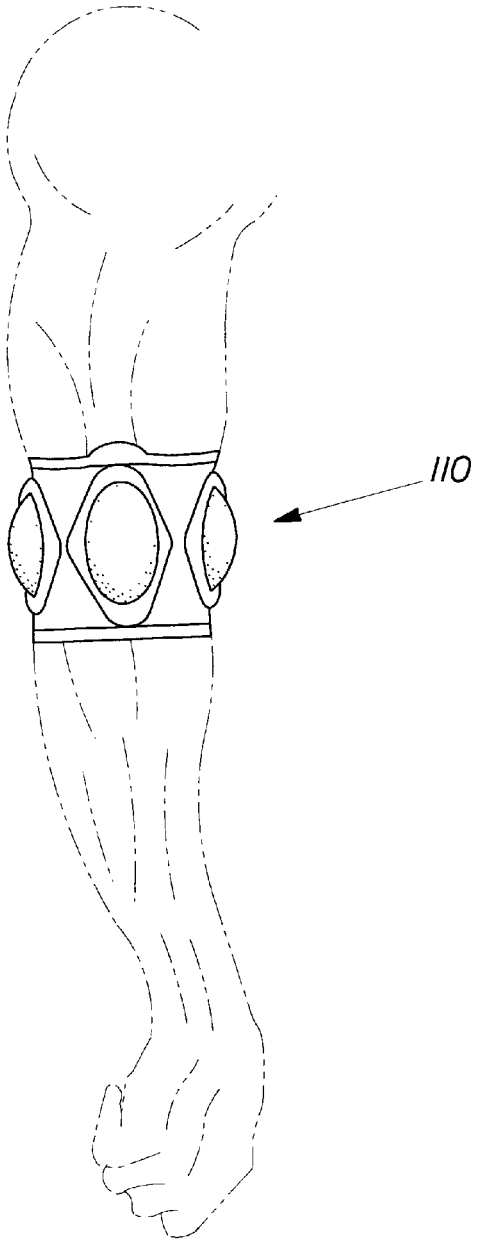
FIG. 5 is a side view of an alternative embodiment of the impact structure shown being worn about an arm.
Figure 5A:
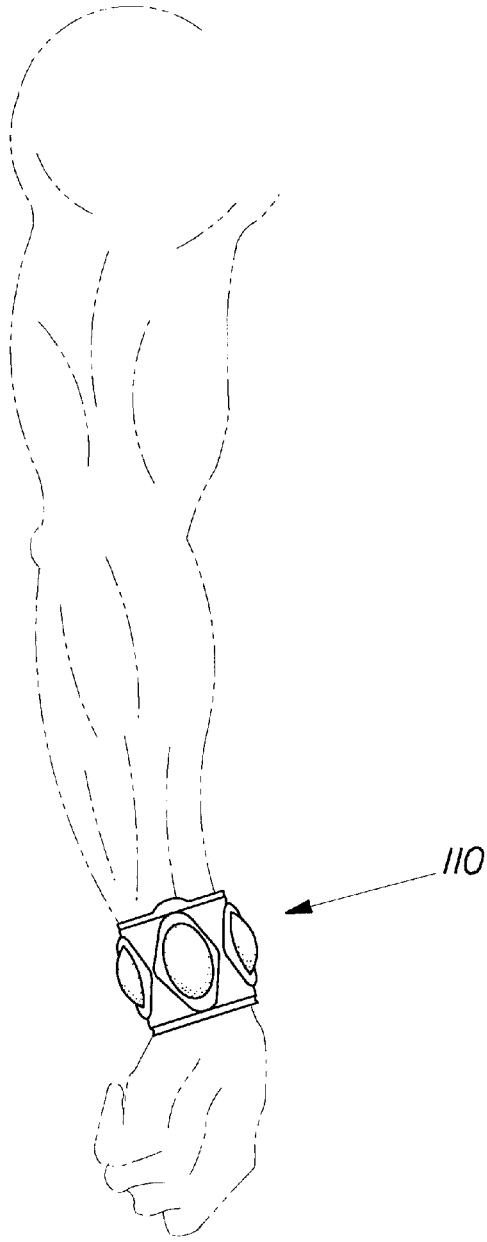
FIG. 5A is a side view of an alternative embodiment of the impact structure shown being worn about the wrist.

FIG. 5 shows a side view of the impact structure 10. The protective cover 40 is shown as covering only a portion of the sheath 25. This partial covering is configured to anatomically provide the proper protection to an impact area, e.g., an elbow joint, that is necessary. It should be noted, however, that depending upon the part of wearer's body that is meant to be protected, a protective cover 40, as well as the entire impact structure 10, can be so designed so as to provide anatomical protection to an impact structure adorned area. By the term "anatomical protection" it is meant herein that the structure 10 will provide an anatomical fit to a given area, e.g., elbow, knee, bicep, quadriceps, etc., and protect an impacted area on a wearer's body maximally in accordance with the design of the impact structure 10.

Figure 12:
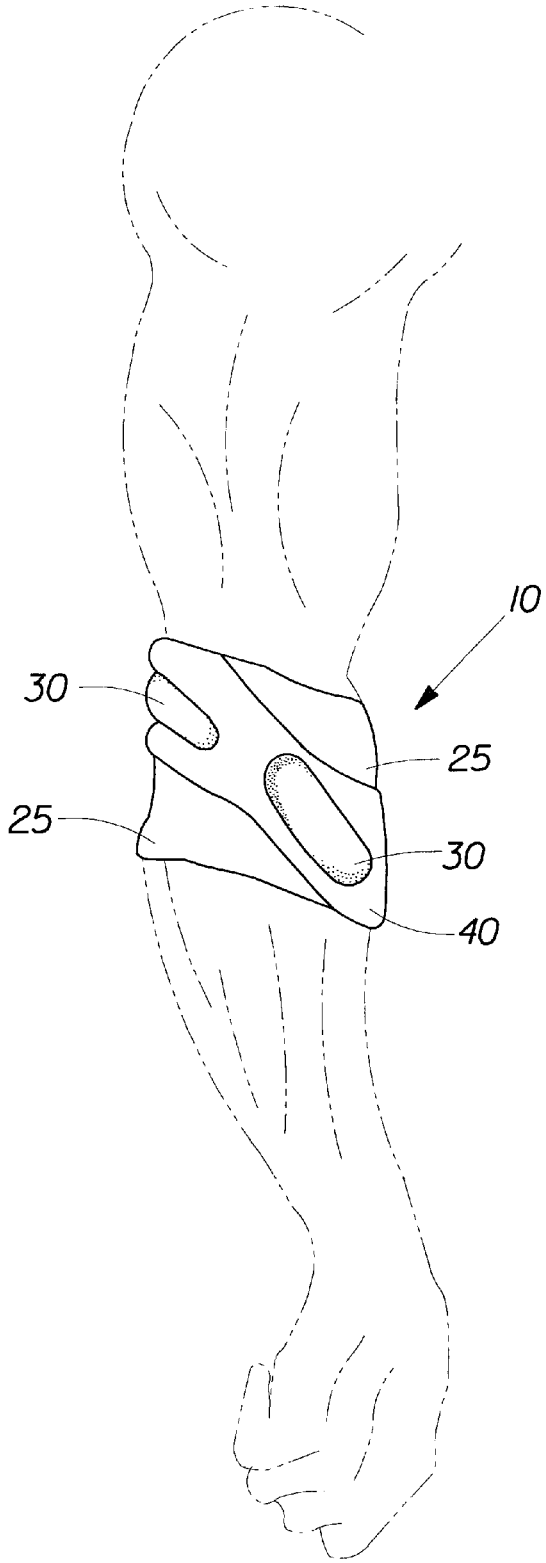
FIG. 12 is a side view of the impact structure shown being worn about an arm.

FIG. 12 shows such a specially designed impact structure 10 for the fit about a wearer's arm. As is shown, the impact structure 10 is anatomically designed to not only fit the geometric proportions of the arm but also to provide maximum protection from impact forces which might impact the wearer's arm in, for example, a sporting match. More specifically, the impact structure 10 shown in FIG. 12 is designed to provide protection from impact about the wearer's elbow and forearm muscles. The sheath 25 also may provide a measure of protection dependent upon the compressive forces exerted by the sheath 25 to the arm. A manufacturer may design the sheath 25 to be as tight or as loose as a wearer may desire. However, while not wanting to be bound by any particular theory, it is my belief that the combination of a tightly fitted sheath 25 and protective cover 40 (where present) helps to secure a greater range of protection from impact forces to a wearer.

FIGS. 12A and 12B provide a view of the impact structure 10 positioned about the arm of a wearer. In particular, FIG. 12A shows the underlying major muscle groupings. FIG. 12B shows the underlying major bone structure of the wearer's arm. Both figures provide an anatomical perspective of the fit of the impact structure 10 as against a wearer's arm and those points or areas of desired protection.

Figure 11:
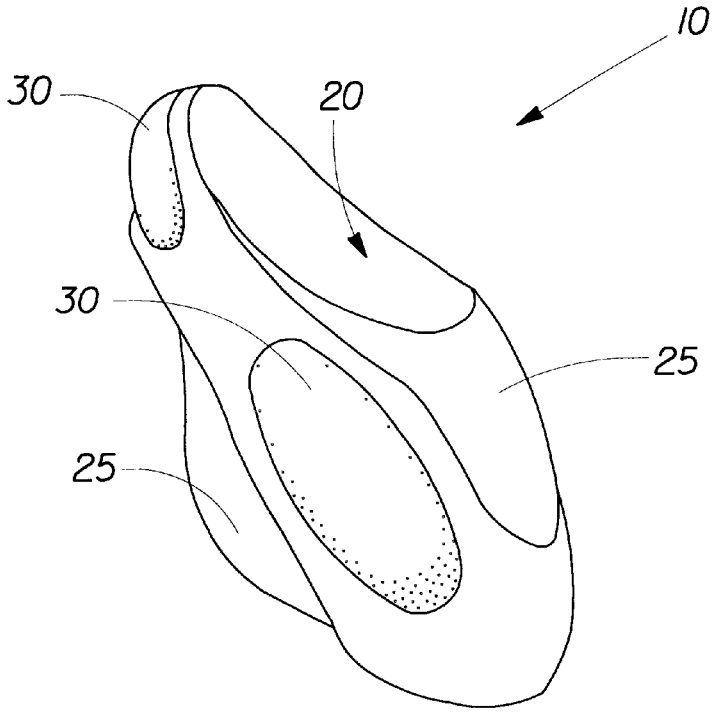
FIG. 11 is a perspective view of the impact structure.

FIG. 11 provides a perspective view of the impact structure 10 having a sheath 25, impact zones 30, and a protective cover 40. It should be noted herein that a manufacturer may place any amount of impact zones 30 on and/or within the impact structure 10 as is practicable. Also, the impact zones 30 may 1) range in height from about 0.01 inches to about 40 inches, 2) range in width from about 0.01 inches to about 80 inches, and 3) range in depth, i.e., the height of its protuberance from the surface of the sheath 25, from about 0.01 inches to about 15 inches.

Preferably, the impact structure 10 is multi-dimensional, i.e., not planar or flat, and may comprise between about 1 to about 100 impact zones. The impact zones 30 are generally raised structures from the surface of the impact structure 10 or sheath 25. The zones 30 may be ornamental but are preferably chiefly designed to receive and absorb substantially all of the force of an impact thereon. Note that for the purposes herein the terms "shock", "force" and "stress" are interchangeable and all refer to the phenomenon occurring when a force is applied to the impact structure 10. When one or more of the impact zones 30 is struck, it will offer a counter force in the direction of the impact, will absorb the force without substantially transferring the impact force to the body part of a wearer and dissipate that absorbed force through heat energy, and/or disperse the force throughout the impact zone 30 such that a substantial portion of the impact force is not translated to a wearer's body positioned underneath the impact structure 30.

The impact structure 30 may be used to fit about various joints (e.g., elbow, knee, etc.) or it may cover flesh portions of a wearer's body or it may cover both. For example, in one embodiment herein, the impact structure 30 may be fitted against a portion of a wearer's forearm just below, but possibly including, the elbow (FIG. 12).

In day to day use, the impact structure 10 may protect and provide support to a forearm which has been injured or is susceptible to injury. For example, for one who plays a sport such as tennis or basketball, the fitted impact structure 10 may be placed about the forearm where minor stress ailments in the muscles or tendons thereof or fractures in the bones therein may occur. Many people who play sports and especially sports professionals may incur minor but painful injuries such as tendonitis, i.e., "tennis elbow".

Tendonitis, an inflammation of the tendon, is caused by repeated pressure on the tendons in the writs and forearm from any activity that involves moving a joint while exerting pressure. "Tennis elbow" is one of the more commonly known forms of tendonitis and is treated by putting the arm into a sling to immobilize the elbow. Since the arms are the conduits for the reflexology points on the hands, it should be immediately apparent how important the health of the arms and shoulders can be to the general health of the body. Therefore, when the impact structure 10 is worn, for example, about the forearm of a wearer engaged in a contact sport like basketball, football, or soccer, the forearm will receive protection from impacts that can normally occur in such fast-paced sports. Such protection would relieve the forearm of much if not all of the impact stresses applied to a wearer.

As mentioned previously herein, the pads would preferably be fitted to the joint of a wearer such that when the impact structure is applied to a body part and specifically a joint of a wearer, the undersurface of the impact structure conforms to that body pad. Such impact structure conformation occurs due to the fitted characteristics of the impact structure undersurface. Preferably the impact structure undersurface comprises elastic material that enables the impact structure undersurface to fit to a wearer. In one embodiment herein, the impact structure undersurface is either attached to the regular surface of the impact structure or comprises at least a portion of the regular surface of the impact structure or substantially comprises the regular surface of the pad.

The impact structure may be used to fit about various joints (e.g., elbow, knee, etc.) or it may cover flesh portions of a wearer's body or it may cover both. For example, in one embodiment herein, the impact structure may be fitted against a portion of a wearer's forearm just below, but possibly including, the elbow. In day to day use, the impact structure may protect and provide support to a forearm which has been injured or is susceptible to injury. For example, for one who plays a sport such as tennis or basketball, the fitted impact structure may be placed about the forearm where minor stress ailments in the muscles thereof or fractures in the bones therein may exist. Many people who play sports and especially sports professionals may incur minor but painful injuries such as tendonitis, i.e., "tennis elbow".

In an alternative embodiment herein, FIGS. 1–5A shows an alternative embodiment of the impact structure 110 herein. The impact structure 110 shown in FIGS. 1–5A has all of the same features as the impact structure 10 previously discussed and shown in FIGS. 6–12B except for the feature of anatomical fit about a wearer's body. More specifically, the embodiment shown in FIGS. 1–5A is not specifically designed to be anatomically placed for protection on various parts of a wearer. Rather, the impact structure 110 may also fit snugly to a wearer, e.g., a wearer's arm or wrist (FIGS. 5 and 5A), and will protect and preferably adapt to and move with the movements of a wearer without concern for specific anatomical alignment of the impact zones 130 to a wearer's body.

Beyond the above-mentioned difference, the impact structures 10 and 110 are substantially the same in materials, structure, function and purpose. For example, the impact structure 110 comprises impact zones 130 having an outer cover 132 and inner substance 134 (not shown). The impact structure 110 may also comprise a sheath 125 which preferably, but not necessarily, provides a snug fit a wearer. Preferably, also, the sheath 125 would be permeable to air, absorbent to liquid (like sweat) and move and bend easily with the movements of a wearer without losing its form, shape or comfort. Like the impact structure 10, the structure 110 comprises a pair of openings 120 through which a wearer inserts a body part (e.g., an arm, thigh, wrist, ankle, neck, etc.). Alternatively, the impact structures 10 and 110 may be secured along a line of joinder that allows the structures 10 and 110 to be opened and closed about a wearer's body part; such opening and closing structure being similar to that employed by neck braces or removable casts.

While particular embodiments of the present invention have been illustrated and described, it would be obvious to those skilled in the art that various other changes and modifications can be made without departing from the spirit and scope of the invention.

What is claimed is:

1. A flexible and resilient impact structure for the absorption of impact forces directed toward a wearer and positioned onto a wearer's body, comprising:

a sheath having two ends, an opening positioned at each said end, a perimeter positioned about each said end; and at least one impact zone positioned on the impact structure, the impact structure positioned to face outwardly from the surface of the sheath the impact structure further comprising a protective cover positioned about the sheath of the impact structure, the protective cover having two ends, an opening positioned about each said end, and a perimeter positioned about each said end, the protective cover further comprising at least one opening on the surface thereof to allow at least one impact zone to protrude therethrough from the surface of the sheath.

2. The impact structure of claim 1 having a plurality of impact zones positioned externally onto the sheath.

3. The impact structure of claim 2 wherein the plurality of impact zones comprise separate, unattached elements to one-another.

4. The impact zone of claim 2 wherein the plurality of impact zones at least partially interconnected.

5. The impact structure of claim 4 wherein the impact zones form an interconnected network.

6. The impact structure of claim 1 wherein the at least one impact zone is attached to the sheath.

7. The impact structure of claim 1 wherein the at least one impact zone is integrated into the sheath of the impact structure.

8. The impact structure of claim 1 wherein the at least one impact zone and the sheath of the impact structure comprise two distinct elements.

9. The impact structure of claim 8 wherein the impact zone and the sheath are attached to one-another about lines of joinder.

10. The impact structure of claim 1 wherein the protective cover is at least partially attached to the sheath.

11. The impact structure of claim 10 wherein the perimeter at each end of the protective cover is joined to the perimeter at each end of the sheath.

12. The impact structure of claim 1 wherein the protective sheath is made from one or more of the materials from the group consisting of leather, nonwovens, cotton, polyester, polyethylene, polypropylene, foam, sponges, rayon, or any combination of the foregoing.

13. The impact structure of claim 1 wherein the impact zone comprises at least one material from the group consisting of inert gases, air, water, sand, foam, sponges, liquids, semi-solids, solids and combinations of the foregoing.

* * * * *